United States Patent [19]

Dohi

[11] Patent Number: 4,966,565

[45] Date of Patent: Oct. 30, 1990

[54] CRIMP-STYLE TERMINAL AND METHOD OF CONNECTING CRIMP-STYLE TERMINAL AND ELECTRIC CABLE TOGETHER

[75] Inventor: Hikoo Dohi, Shizuoka, Japan

[73] Assignee: Yazaki Corporation, Tokyo, Japan

[21] Appl. No.: 417,224

[22] Filed: Oct. 4, 1989

[30] Foreign Application Priority Data

Oct. 13, 1988 [JP] Japan ..... 62-255945

[51] Int. Cl.[5] ..... H01R 4/02

[52] U.S. Cl. ..... 439/874; 29/860

[58] Field of Search ..... 439/865, 874, 877; 174/94 R; 29/860

[56] References Cited

U.S. PATENT DOCUMENTS 4,163,869 8/1979 Almand et al. ..... 174/94 R 4,579,404 4/1986 Lockard ..... 439/874 X

*Primary Examiner*—Eugene F. Desmond

*Attorney, Agent, or Firm*—Sughrue, Mion, Zinn, Macpeak & Seas

[57] ABSTRACT

A crimp-style terminal and a method of connecting the same is provided in which an exposure portion is provided in the cable conductor-clamping portion of the crimp-style terminal. The exposure portion is used for fusing a cable and the conductor-clamping portion together.

9 Claims, 2 Drawing Sheets

CRIMP-STYLE TERMINAL AND METHOD OF CONNECTING CRIMP-STYLE TERMINAL AND ELECTRIC CABLE TOGETHER

BACKGROUND OF THE INVENTION

The present invention relates to the art of a connection between a crimp-style terminal (or crimp contact) and an electric cable, and more particularly to easily achieving stable contact resistance.

FIG. 4 shows a conventional connection between a crimp-style terminal and an electric cable. The crimp-style terminal 10 has an electric connective portion 11 at one end, and has at the other end a conductor clamping portion 12. Reference numeral 13 denotes a sheath clamping portion which serves to increase the connection strength when clamping the cable. The conductor clamping portion 12 has a U-shaped cross-section and a base 11*a* extending from the electric connective portion 11, and a pair of press-deformable arms 12*a* and 12*a* formed perpendicularly on the lateral edges of the base, respectively. A sheath is removed from a distal end of the cable 6, and the distal end of the cable 6 is placed on the clamping portions 12 and 13 with a conductor 6*a* exposed. Then, the conductor clamping portion 12 is subjected to forces from the upper and lower sides, as indicated in arrows, by clamping jigs 14 and 15, so that the conductor 6*a* is clamped by the conductor clamping portion 12. Also, the sheath clamping portion 13 is pressed by jigs (not shown) similar to the jigs 14 and 15, to hold the sheath 6*b*. The upper jig 14 has a pressing groove 14*a* having a triangular projection at its center, and the lower jig 15 has a shallow concave groove 15*a*. With such construction of the jigs 14 and 15, the conductor 6*a* and the conductor clamping portion 12 are brought into contact with each other over the entire length L and an electrical connection is made therebetween.

In the above prior art, however, if the dimensions C/W and C/H of the crimp-style terminal are not suitable as shown in FIG. 5, a gap 16 occurs between the conductor clamping portion 12 and the conductor 6*a*, which affects the reliability of the electrical connection. Therefore, it has been necessary to prepare many kinds of crimp-style terminals having various C/W and C/H dimensions, in accordance with various sizes of cables and kinds of terminals. Further, if the storage conditions are not proper, oxide films develop on the surfaces of the clamping portion and conductor, and dust or the like deposits on these surfaces. Thus, such foreign matter must be removed when in use. This results in additional cumbersome labor. For these reasons, conventionally, it has been necessary to strictly control the storage of many kinds of terminals, which has increased the cost and lowered productivity.

SUMMARY OF THE INVENTION

The present invention has been made in view of the above problems, and an object of the invention is to provide a crimp-style terminal and a method of connecting the same, by which the connection reliability between the crimp-style terminal and the cable is enhanced, and the number of different kinds of such crimp-style terminals can be reduced.

The above object has been achieved by a crimp-style terminal having a cable conductor-clamping portion, in which an exposure portion for fusing a conductor is provided at the conductor clamping portion.

According to the present invention, a method of connecting a crimp-style terminal and a cable together is also provided, comprising the steps of exposing a conductor at a distal end of the cable; placing the exposed conductor on a conductor clamping portion; applying oppositely-directed forces to the conductor clamping portion to clamp the same to the conductor; and applying a light ray to an edge of the conductor clamping portion biting in the conductor and/or the conductor itself to heat the same, thereby fusion-bonding the conductor clamping portion and the conductor together.

BRIEF DESCRIPTION OF THE DRAWINGS

FIG. 1(*a*) is its perspective view; FIG. 1(*b*) is a cross-sectional view taken along the line A—A of FIG. 1(*a*).

FIG. 2(*a*) is a perspective view of the overall construction; FIG. 2(*b*) is a cross-sectional view taken along the line B—B of FIG. 2(*a*).

DESCRIPTION OF THE PREFERRED EMBODIMENTS

Preferred embodiments of the present invention will now be described with reference to the drawings.

Figure 1A:
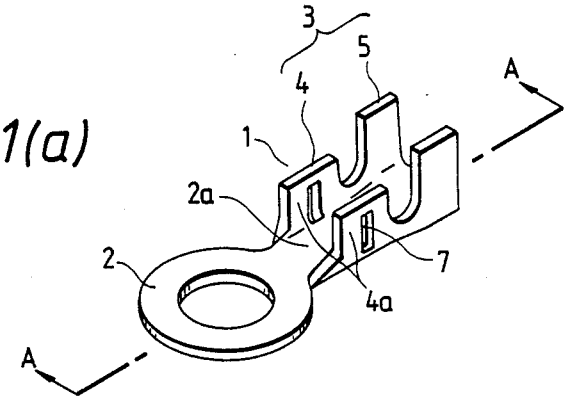
FIGS. 1(*a*) and 1(*b*) show a crimp-style terminal according to the present invention.
Figure 1B:
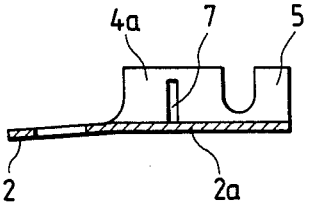

As shown in FIG. 1, a crimp-style terminal 1 is formed by bending and stamping a sheet made, for example, of brass. The terminal 1 has an electric connective portion 2 at one end, and has a cable clamping portion 3 at the other end. The cable clamping portion 3 has a conductor clamping portion 4 and a sheath clamping portion 5 for holding an insulative sheath. The conductor clamping portion 4 makes an electrical connection, and the sheath clamping portion 5 increases the strength of the connection. The conductor clamping portion 4 is formed in a U-shaped cross-section and has a base 2*a* extending from the electric connective portion 2, and a pair of press-deformable arms 4*a* and 4*a* perpendicularly formed respectively on the lateral edges of the base. Each press-deformable arm 4*a* has a slit-like through hole 7 extending in a direction perpendicular to the axis of the crimp-style terminal. The through hole 7 serves as a fusion bonding exposure portion for exposing a conductor 6*a* (see FIG. 4) of an electric cable 6.

Figure 2A:
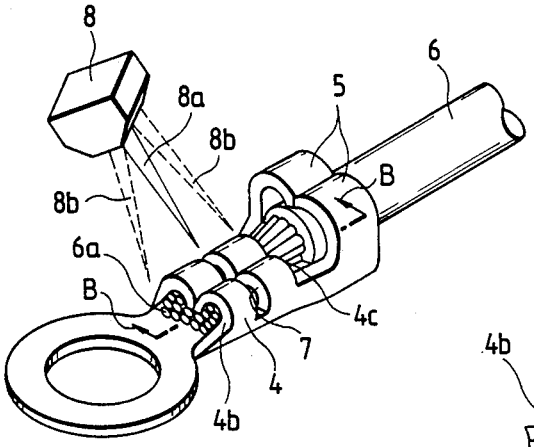
FIG. 2 shows a method of the present invention.
Figure 2B:
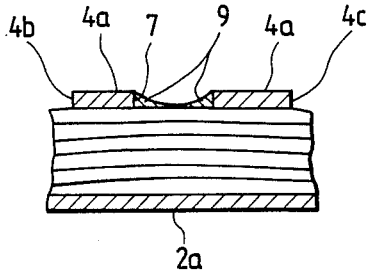

A clamping method will now be described with reference to FIG. 2. As described above, the sheath 6*b* is removed from the distal end of the cable 6, and the distal end of the cable is placed on the cable clamping portion 3, with the conductor 6*a* exposed. Then, oppositely-directed forces are applied to the cable clamping portion from the upper and lower sides to effect the clamping, so that an electrical connection between the conductor 6*a* and the crimp-style terminal 1 is made. With this clamping force, the opposite ends or edges of the conductor clamping portion 4 bite into the conductor 6*a*. In addition, the lateral edges of each exposure portion 7 bite into the conductor 6*a*. With this clamping force, the conductor 6*a* slightly projects into the exposure portion 7.

Figure 4:
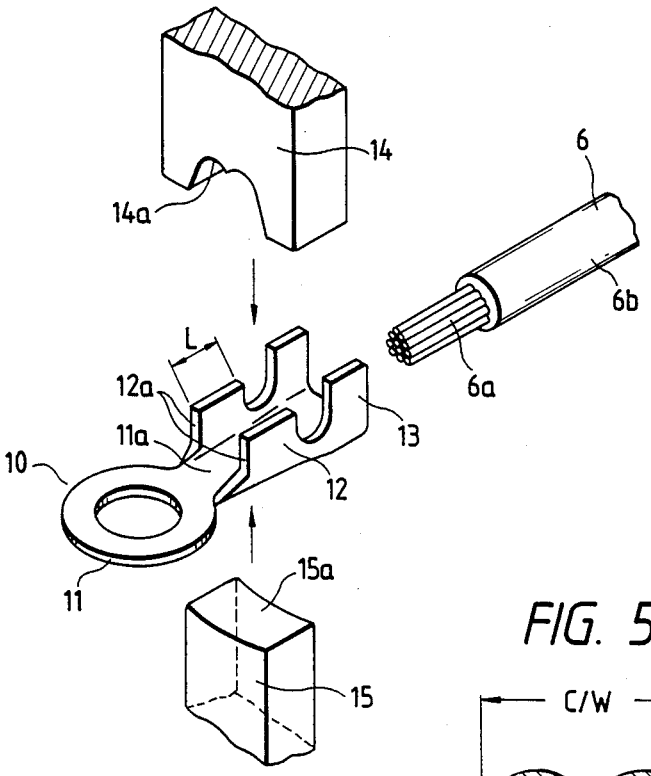
FIG. 4 PRIOR ART
FIG. 4 is an exploded, perspective view showing a method of clamping a conventional crimp-style terminal.
Figure 5:
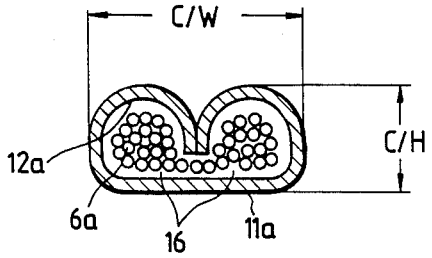
FIG. 5 is a cross-sectional view of a conductor clamping portion clamped with the conventional method.

Reference numeral 8 denotes a light beam or laser generating device which is positioned, for example, adjacent to clamping jigs (see reference numerals 14 and 15 in FIG. 4). A strong convergent light 8*a* emitted from the light beam or laser generating device 8 is applied to both the lateral edges of the exposure portion 7 and those portions of the conductor 6*a* into which these lateral edges bite. Those portions to which the light is applied are heated to be fused or melted at their surfaces to achieve fusion-bonding as at reference numeral 9 in FIG. 2(*b*). In addition to the application of the light to the exposure portion 7, by applying a light beam 8*b*, indicated by broken lines in FIG. 2, to the front end (edge) 4*a* or the rear end (edge) 4*b* of the press-deformable arm 4*a*, the area of fusion bonding can be increased. With this fusion bonding, the reliability of the electrical contact can be markedly improved over that achieved only with a press clamping. If there is a difference in melting points between the conductor clamping portion 4 and the conductor 6*a*, only one of them may be fused. The light beam or laser generating device 8 can be easily mounted on previously installed equipment by a suitable mounting means so as to be disposed adjacent to the clamping jigs.

The exposure portion 7 is provided for the purpose of increasing the area of fusion bonding, as described above. Therefore, its shape is not restricted to the illustrated slit-like shape, but can be in the form of a round hole or a plurality of holes. Also, such exposure portion may be in the form of a through hole 2*b* (FIG. 3) formed through the base 2*a* of the conductor clamping portion 4. At the time of clamping, the conductor 6*a* is partially forced into the exposure portion 7, and therefore the area of contact is increased. In addition, enhanced reliability is provided since the crimp-style terminal is prevented from being pulled out of the cable when the cable is pulled.

Figure 3:
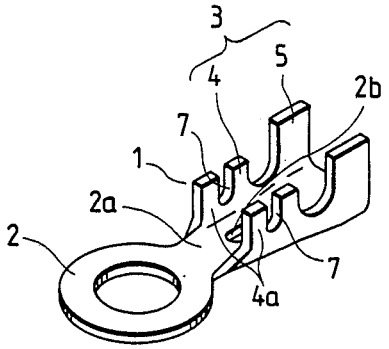
FIG. 3 is a perspective view of a modified crimp-style terminal.

FIG. 3 shows a modified form of the invention in which an exposure portion 7 is in the form of a notch extending from the distal end of the press-deformable arm 4*a* toward the base 2*a* to divide the press-deformable arm 4*a* into two sections.

The present invention is similarly applicable to a crimp-style terminal with a conductor clamping portion of a cylindrical shape, as opposed to the conductor clamping portion 4 of a U-shape. Moreover, the present invention is also applicable to a crimp-style terminal having no electric connective portion 2.

As described above, the present invention achieves the following advantages.

Since heating is effected by the application of the light beam, fusion bonding can be carried out without requiring any contact with the conductor clamping portion at all. Therefore, unnecessary stress is not applied to this portion.

In addition, a good electrical connection can be obtained with fusion bonding. Therefore, even if a small gap exists between the conductor and the conductor clamping portion, the electrical contact is not adversely affected. Therefore, the number of kinds of crimp-style terminals to be used can be reduced.

Finally, the device can be easily mounted additionally on an already-installed equipment.

What is claimed is:

1. A crimp-style terminal comprising:

cable clamping means for clamping a conductor wire, said cable clamping means including a conductor clamping portion, a base that is integrally formed with said conductor clamping portion, said conductor clamping portion comprising at least one pair of press-deformable arms substantially perpendicularly formed respectively on lateral edges of said base, and an opening extending through each of said press-deformable arms for fusing an exposed portion of said conductor wire; and an electric connective portion extended from said base.

2. A crimp-style terminal according to claim 1, further comprising sheath clamping means for clamping a coated portion of said conductor wire.

3. A crimp-style terminal according to claim 1, wherein said cable clamping means is of a U-shape.

4. A crimp-style terminal according to claim 1, wherein said cable clamping means is of a cylindrical shape.

5. A crimp-style terminal according to claim 1, wherein each said opening is a notch formed in each of said press-deformable arms and extending from a distal end each of said arms.

6. A crimp-style terminal according to claim 1, wherein each said opening has a slit-like shape.

7. A method of connecting a crimp-style terminal and a cable together, comprising the steps of:

exposing a conductor at a distal end of a cable;

placing said exposed conductor on a conductor clamping portion of a crimp-style terminal, said conductor clamping portion comprising press-deformable arms extending along opposite sides of said exposed conductor, said press-deformable arms each having an opening therein;

applying oppositely-directed forces to said press-deformable arms to clamp the same to said conductor; and applying a light ray through each said opening to an edge of said conductor clamping portion biting in said conductor and/or to said conductor itself so as to heat the same, so as to fusion-bond said conductor clamping portion and said conductor together.

8. A method according to claim 7, in which said light ray is a light beam.

9. A method according to claim 7, in which said light ray is a laser beam.

* * * * *